US007000804B2

(12) United States Patent
Illuzzi et al.

(10) Patent No.: US 7,000,804 B2
(45) Date of Patent: Feb. 21, 2006

(54) CONTAINER DISPENSER DEVICE FOR SEPARATED FLOWABLE CONTENTS

(76) Inventors: Louis Illuzzi, 4 Carlisle Ct., Manalapan, NJ (US) 07726; Nicole Illuzzi, 4 Carlisle Ct., Manalapan, NJ (US) 07726

( * ) Notice: Subject to any disclaimer, the term of this patent is extended or adjusted under 35 U.S.C. 154(b) by 16 days.

(21) Appl. No.: 10/783,483

(22) Filed: Feb. 20, 2004

(65) Prior Publication Data

US 2005/0184092 A1 Aug. 25, 2005

(51) Int. Cl.
*B67D 5/60* (2006.01)

(52) U.S. Cl. ..... 222/145.5; 222/423; 222/424; 222/459; 222/564

(58) Field of Classification Search ..... 222/145.5, 222/145.6, 190, 212, 423, 424, 459, 564
See application file for complete search history.

(56) References Cited

U.S. PATENT DOCUMENTS 4,570,830 A 2/1986 Jeans
4,848,602 A * 7/1989 Yoshimura et al. ..... 222/564
5,579,962 A * 12/1996 Chen ..... 455/66.1
5,597,254 A 1/1997 Vasas
6,062,441 A 5/2000 Mengeu et al.
6,315,140 B1 11/2001 Nadel
6,315,160 B1 * 11/2001 Gaiser et al. ..... 222/1
6,412,664 B1 7/2002 Wolff et al.
6,488,186 B1 * 12/2002 Gaiser et al. ..... 222/459
6,527,109 B1 3/2003 Schoo et al.
6,689,279 B1 * 2/2004 Train ..... 210/800
2003/0218935 A1 * 11/2003 Hu ..... 366/247

* cited by examiner

*Primary Examiner*—Joseph A. Kaufman
(74) *Attorney, Agent, or Firm*—Kenneth P. Glynn, Esq.

(57) ABSTRACT

The present invention is a container dispenser device for handling separated flowable contents of a container. This device is placed under a cap of a container, or, alternatively, replaces a cap of a container and includes cap features itself. The present invention device includes: (a) a base member, the base member having a top and a bottom, and having a top view footprint with a perimeter adapted to fit onto and seal a dispensing opening of a container, the base member having a dispensing orifice located thereon; (b) a separator tube connected to the bottom of the base member at the dispensing orifice and extending downwardly therefrom; and (c) at least one mixing rib external from the separator tube and connected to at least one of the separator tube and the base member, and extending downwardly away from the bottom of the base member. It may also include a side wall with cap features.

20 Claims, 4 Drawing Sheets

CONTAINER DISPENSER DEVICE FOR SEPARATED FLOWABLE CONTENTS

BACKGROUND OF THE INVENTION

1. Field of the Invention

The present invention relates to container dispenser devices, and more particularly to such devices that will prevent separated flowable content dispensing. For example, the watery top liquid that accumulates over ketchup or mustard has separated from its original composition and is undesirable when it flows out ahead of the ketchup or mustard. The present invention prevents this from occurring by causing the top material (usually less viscous or dense) to initially bypass the exit orifice of the container cap, and aid in remixing it into the original major contents. This is achieved with the present invention device that includes a dispensing orifice, an isolation column and at least one mixing blade. The present invention device may be a cap or an insert that fits under a cap.

2. Information Disclosure Statement

The following patents represent the state of the art relating to modified container dispensing caps:

U.S. Pat. No. 6,527,109 B2 describes a cap for a water bottle or other liquid container. The cap has a liquid-dissolvable disk in it that dissolves in the water when the bottle is shaken. The preferred cap also has an annular cavity between inner and outer walls in the sidewall of the cap into which the liquid can flow through fluid passageways once the disk is at least partially dissolved.

U.S. Pat. No. 6,412,664 B1 describes a cap for use in dispensing viscous liquids from containers without the accompaniment of lower viscosity liquid present in the container. The cap has a top portion with an outside surface and an inside surface and an elongated conduit formed at a pre-determined angle. The elongated conduit has an outlet and an inlet. The outlet is situated either eccentrically or concentrically on the outside surface of the top portion such that at least one point on the circumference of the top portion is greater than 10 milliliters from the edge of the inlet.

U.S. Pat. No. 6,315,140 B1 describes a bottle/cap assembly with sweep-and-drain action including a bottle, a cap and a sweep-and-drain mechanism. The bottle has in series, from the bottom to the top, a closed bottom, a body sidewall, a cylindrical neck sidewall, and an open top. The cap is configured and dimensioned to be rotatably received about the neck sidewall and includes a closed cap top to close the open top and prevent egress of liquid from within the bottle. The sweep-and-drain mechanism includes (i) a circumferentially spaced plurality of vertically extending grooves or slots in the bottle extending downwardly from the open top through said neck sidewall, and (ii) a circumferentially spaced plurality of radially extending vanes or wipers proximate to the open top, rotation of the cap relative to the bottle causes the vanes or wipers to circumferentially sweep and push any liquid accumulated on the open top into a position vertically aligned with the grooves or slots so that such accumulated liquid can drain downwardly through the grooves or slots towards the closed bottom under the influence of gravity.

U.S. Pat. No. 6,062,441 describes a two-piece dispensing closure, which includes a plastic fitment that fits in the mouth of a bottle, a twist type over cap having a central aperture in its top wall for engagement with a post on the top of the fitment and having a sealing wall and lip for sealing over holes through a bottom wall of the fitment.

U.S. Pat. No. 5,597,254 describes a cosmetics container that includes a bottle defining a chamber for containing cosmetics, the bottle including a threaded neck, and a cap removably secured to the neck. The cap has an applicator rod for extending through the neck into the cosmetics chamber and applicator at the distal end of the rod for carrying cosmetics. A wiper has i) a sleeve mounted in the bottle neck, the sleeve defining an outlet through the neck from the cosmetics chamber and, ii) a conical wiper diaphragm extending from the sleeve across the outlet and descending into the cosmetics chamber below the neck. The conical wiper diaphragm defines a central wiper orifice for accommodating passage of the applicator rod and applicator and for wiping excess cosmetics therefrom as the applicator rod and the applicator are withdrawn from the cosmetics chamber. A plurality of substantially evenly spaced-apart vanes extend downwardly from the lower surface of the wiper diaphragm to below the wiper orifice, and each van extending angularly outwardly from the wiper orifice to its trailing edge. Adjacent vanes define a flow channel therebetween for conveying wiped excess cosmetics outwardly from the wiper orifice and for mixing cosmetics, the plurality of vanes defining a plurality of such flow channels. A second, more flexible finishing wiper is provided within the first wiper.

U.S. Pat. No. 4,570,830 describes an apparatus for controlling the dispensing of a concentrate from a container at a predetermined flow rate that includes a first container part a first valve part in communication with a volume of concentrate; a second part having a second mating valve part and an outlet opening therein, the second part movable with respect to the first part to selectively move the first and second valve parts with respect to each other with a preselected amount to permit flow of the concentrate from the first part, through the valve parts and out the outlet opening; cams for effecting movement of the first and second parts, the preselected amount with respect to each other; a tube to introduce air at atmospheric pressure into the container when the first and second valve parts are moved apart having a cooperating valve to prevent back flow through the tube when the first and second valve parts are in sealing relationship; and a chamber interposed between the volume of concentrate and the tube having an outlet fixed near the outlet opening, the chamber outlet being of a size which will permit a free flow of air whereby air will escape from the chamber, despite any surface tension existing in the concentrate, to replace concentrate which is dispensed through the outlet opening in such a manner so as to maintain a constant head pressure in the interior of the container.

Notwithstanding the prior art, the present invention is neither taught nor rendered obvious thereby.

SUMMARY OF THE INVENTION

The present invention is a container dispenser device for handling separated flowable contents of a container. This device is in the form of a structure that is placed under a cap of a container, or, alternatively, replaces a cap of a container and includes cap features itself. There are many liquid mixtures that separate when left standing for a time, and these include some medications, foods; such as ketchup and mustard, some cosmetic solutions, and others. It is annoying and sometimes distasteful for the liquid tops (typically less viscous watery juices), to come out of a container ahead of the desired mixture, and the present invention devices are directed to holding these tops liquids in the container, and are further directed to intermixing the tops with the main liquid mixture, prior to or during dispensing.

The present invention device, in one form, includes: (a) a base member, the base member having a top and a bottom, and having a top view footprint with a perimeter adapted to fit onto and seal a dispensing opening of a container, the base member having a dispensing orifice located thereon; (b) a separator tube connected to the bottom of the base member at the dispensing orifice and extending downwardly therefrom; and (c) at least one mixing rib external from the separator tube and connected to at least one of the separator tube and the base member, and extending downwardly away from the bottom of the base member.

In some preferred embodiments, the container dispenser device, the base member is circular in shape. It could be otherwise, as in the case, for example, wherein it has any shape center, e.g., a square or octagon, with spokes radiating outwardly to rest on the open end of a container and under any type of conventional cap. However, a circular shape, having a diameter size about the diameter of the inside of a cap, is a very much preferred embodiment.

The present invention device may be made of any available, functional substance, but plastic, metal or glass are preferred. Although the present invention device mixing rib may be one such rib, at least two are preferred. Multiple ribs are also viable in the context of the present invention. The present invention container dispenser device mixing rib may be connected to both the base member and the dispenser tube, or it may be connected to one or the other of the base member and the dispenser tube. The mixing rib(s) may be is at least one mixing spike. The mixing spike(s) may be connected to the base member, or the to the dispenser tube, or both. They could be vertical, horizontal, askew or any combination thereof.

Alternatively, the present invention container dispenser device mixing rib(s) may be one or more mixing fins. In some embodiments, these mixing fins may include at least one opening therein to increase agitation and mixing. The mixing fin(s), as with any choice of mixing rib(s), may be connected to the base member, or may be connected to the dispenser tube or both, or some to one or the other and some to both.

In some preferred embodiments, the present invention device is a container dispenser cap device and, thus, has cap features. In these cases, the base member has attachment means for attaching the cap device to a container. The base member may, for example, have side walls and a lip, hinge, threading or other cap feature for attaching a cap to a container. It could have other cap features as well, such as a push-pull feature, a snap feature, a child resistant feature, or the like. Thus, the present invention device in either the cap form or the insert form will operate, via the dispenser tube, to keep the top juices from premature dispensing and will aid in admixture thereof back to the main mixture.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
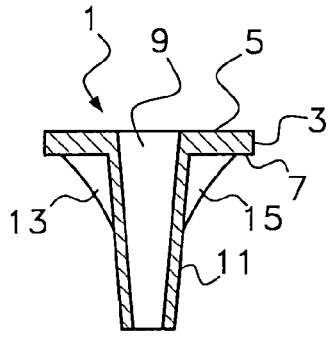
FIG. 1 shows a front cut view of a present invention container dispenser device for handling separated flowable contents.

FIG. 1 shows a front cut view of a present invention container dispenser device 1, for handling separated flowable contents. It includes a base member 3, having a base member top 5 and a base member bottom 7. Base member 3 has a dispensing orifice 9 located thereon and passing there through. Extending downwardly away from the base member 3 at the orifice 9 and coinciding therewith, is dispensing tube 11. The orifice 9 and dispensing tube 11 are shown centered and in the singular. These could be off-center, and, in some embodiments, could be in the plurality, without exceeding the scope of the present invention. Connected to both the bottom 7 of base member 3 and the dispensing tube 11 are a plurality of mixing ribs, in this case, fins 13 and 15 are shown.

Figure 2:
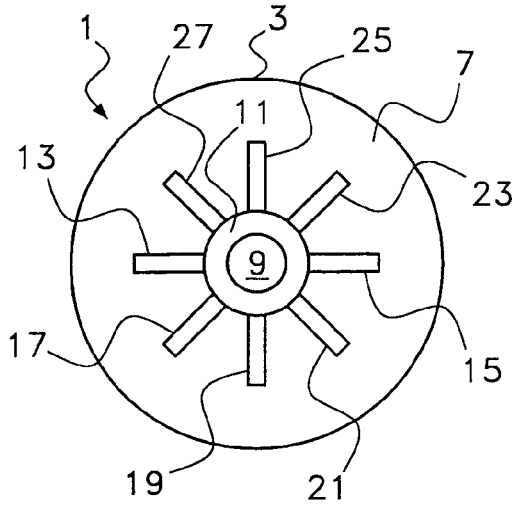
FIG. 2 shows a bottom view of the present invention device shown in FIG. 1.
Figure 3:
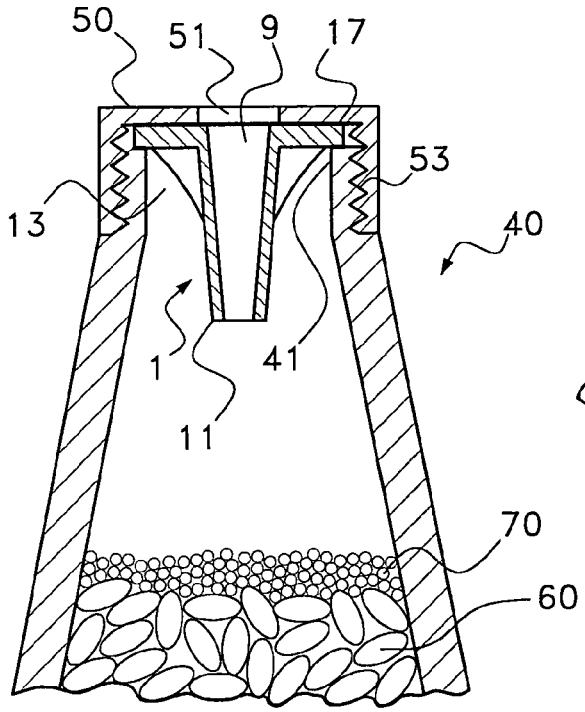
FIGS. 3 and 4 show partial, cut views of a container with the FIG. 1 present invention device, in its upright and pouring positions, respectively.
Figure 4:
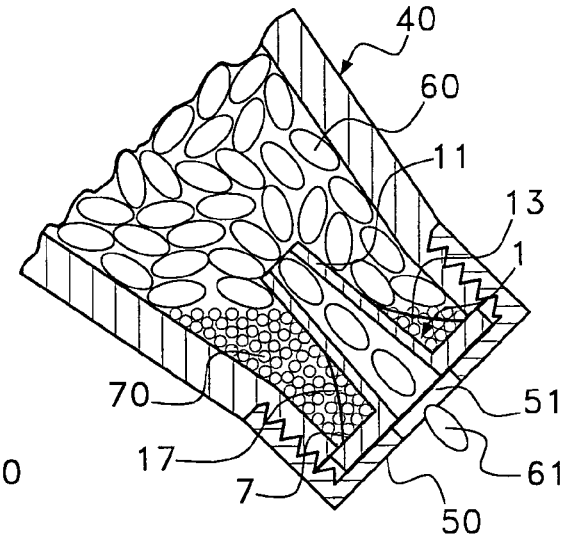

FIGS. 2, 3, and 4 include the present invention device 1 of FIG. 1, and identical parts are identically numbered.

As can be seen in FIG. 1 and in FIGS. 3 and 4 below, the height of the dispensing tube 11 is greater than the diameter of the circular base member 3.

FIG. 2 shows a bottom view of the present invention device 1 shown in FIG. 1, and it can be seen in this view that there are eight different fins, namely, fins 13, 15, 17, 19, 21, 23, 25, and 27. While these fins are identical and symmetrical, they may be different sizes and shapes and may be asymmetrical.

FIGS. 3 and 4 show partial, cut views of a container 40 with the FIG. 1 present invention device 1 inserted under screw cap 50 with orifice 9 and dispensing tube 11 in alignment with cap orifice 51. In its upright and pouring positions, respectively. In FIG. 3, container 40 holds a separable liquid mixture, such as ketchup or mustard. Here, the ketchup 60 has a layer of juicy, watery liquid 70 atop it. When container 40 is tipped for pouring, as in FIG. 4, the watery liquid 70 travels mostly down the sides and onto the bottom 7 of present invention device 1. The dispensing tube 11 stops the liquid 70 from flowing out and permits a portion 61 of the major content ketchup 60 to flow out of the container orifice 51. Through agitation of tipping and contact with the mixing fins, such as mixing fins 13, and 15, and in some cases, also through sequencing of the contains, the undesirably separated juicy watery liquid 70 is mixed back into the ketchup 60, thereby solving two problems, namely, keeping the undesired liquid 70 from being dispensed, and, eliminating it by admixing it back into the major liquid (ketchup 70).

Figure 5:
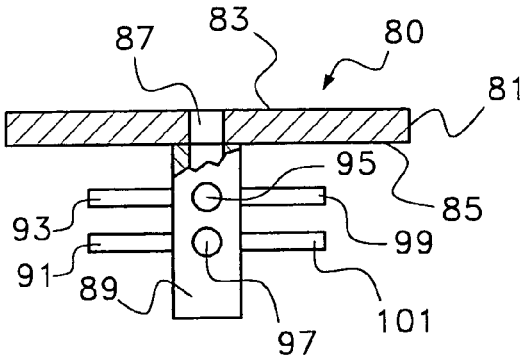
FIG. 5 shows a front, partially cut view of an alternative embodiment present invention container dispenser device.

FIG. 5 shows a front, partially cut view of an alternative embodiment present invention container dispenser device 80. It includes a base member 81, having a base member top 83 and a base member bottom 85. Base member 81 has a dispensing orifice 87 located thereon, as shown. Extending downwardly away from the base member 81 at the orifice 87 and coinciding therewith, is dispensing tube 89. Connected to the dispensing tube 89 and not the bottom 85 of base member 81, are a plurality of mixing ribs, in this case, horizontal spikes or rods 91, 93, 95, 97, 99, and 101. These mixing spikes perform a similar function to the fins described above in conjunction with the above Figures, and the device is used in the same manner as the present invention device described in conjunction with FIGS. 1 through 4, above.

Figure 6:
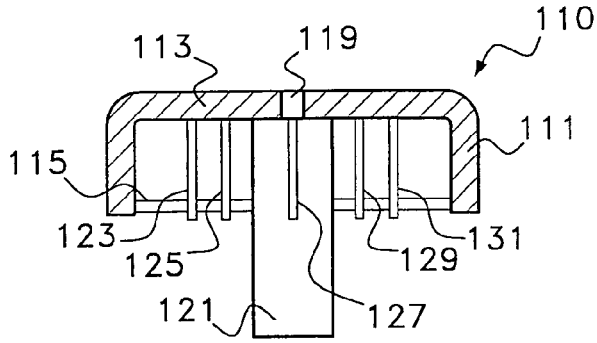
FIG. 6 shows a partially cut, front view of another present invention device in the form of a container dispenser cap device.

FIG. 6 shows a partially cut, front view of another present invention device 110, in the form of a container dispenser cap device. Device 110 includes a base member 113 with sidewall 111, to create a cap. In this case, it is a snap cap and relies on ridge 115 for fittage and closure. This embodiment eliminates a conventional cap and performs both a cap function and the function of the present invention devices described above. In this embodiment, dip 2, 121, feeds to cap dispensing orifice, 119. Vertical mixing rods 123, 125, 127, 129, 131, and others act to agitate separated mixtures and combine them.

Figure 7:
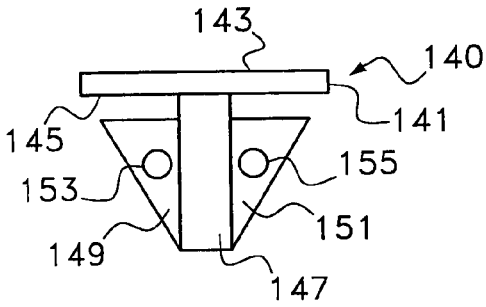
FIG. 7 shows a front view of another present invention device for use under a conventional cap.

FIG. 7 shows a front view of another present invention device, 140, for use under a conventional cap. In this embodiment base member, 141, has a top, 143, with a dispensing orifice (not shown). It also has a bottom, 145, from which the dispensing tube 147 extends downwardly from the central orifice. Mixing fins 149 and 151 are attached to dispensing tube 147 and are not attached to base member 141. Further, mixing fins 149 and 151 include agitating orifices 153 and 155. Present invention device 140 operates in the same manner as present invention device 1 shown in figures above aria.

Figure 8:
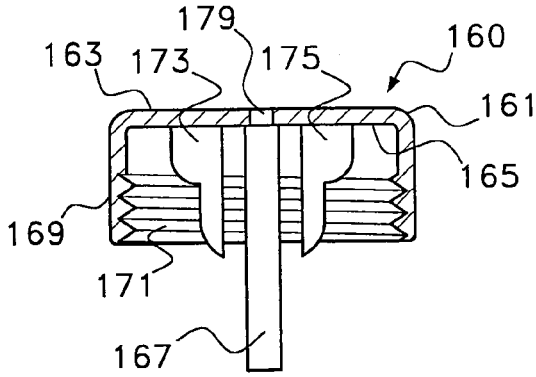
FIG. 8 shows a front, partially cut view of another present invention container dispenser cap device; and, FIGS. 9 and 10 show a preferred embodiment front cut view of a present invention container dispenser cap device separately and screwed onto a container in a pouring position, respectively.

FIG. 8 shows a front, partially cut view of another present invention container dispenser cap device; and, 160. Base member 161 has a top 163 with a dispensing orifice 169. Extending from its bottom 165 are dispensing tube 167 and mixing fins 173 and 175. This device 160 is a screw cap and includes threads 171 on the inside of the wall 169, as shown.

Figure 9:
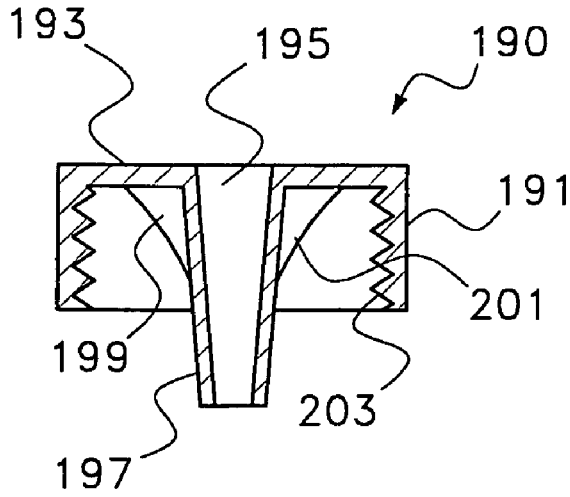
Figure 10:
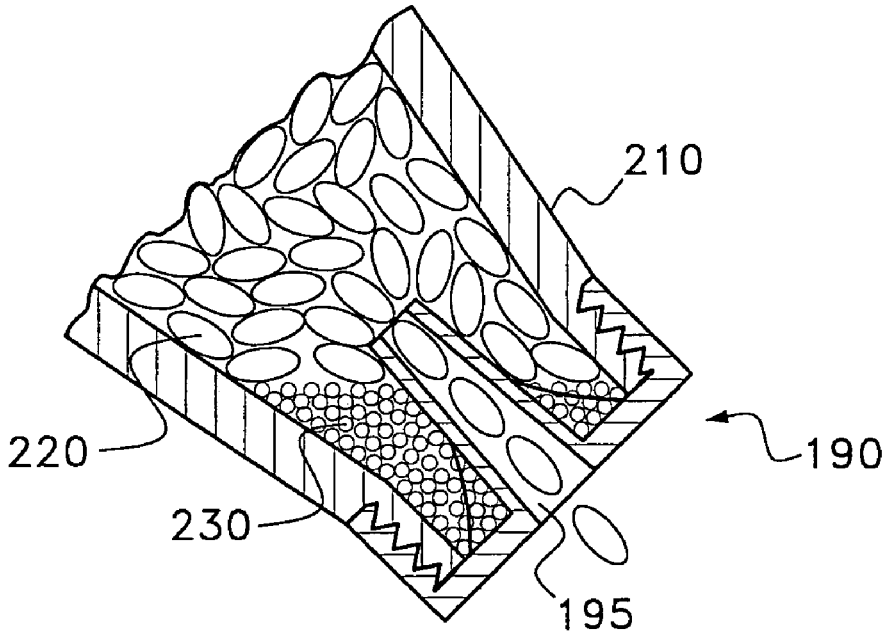

FIGS. 9 and 10 show a preferred embodiment front cut view of a present invention container dispenser cap device 190 separately and screwed onto a container 210 in a pouring position, respectively. Present invention device, 190 is a threaded capped device similar to one shown in FIG. 8, except that the mixing fins are similar to those in the present invention device shown in FIGS. 1 through 4. Base member 193 has an orifice 195 with a dispensing tube 197 extending downwardly therefrom. Side wall 191 includes threads 203. Mixing fins 199 and 201 are connected as shown and operate similarly to the fins of FIG. 1.

FIG. 10 shows device 190 attached to container 210 by being screwed on to it, and they are in the up ended dispensing position, as shown. The primary major liquid, 220 is dispensed while the undesirable liquid 230 is contained and mixed.

Figure 11:
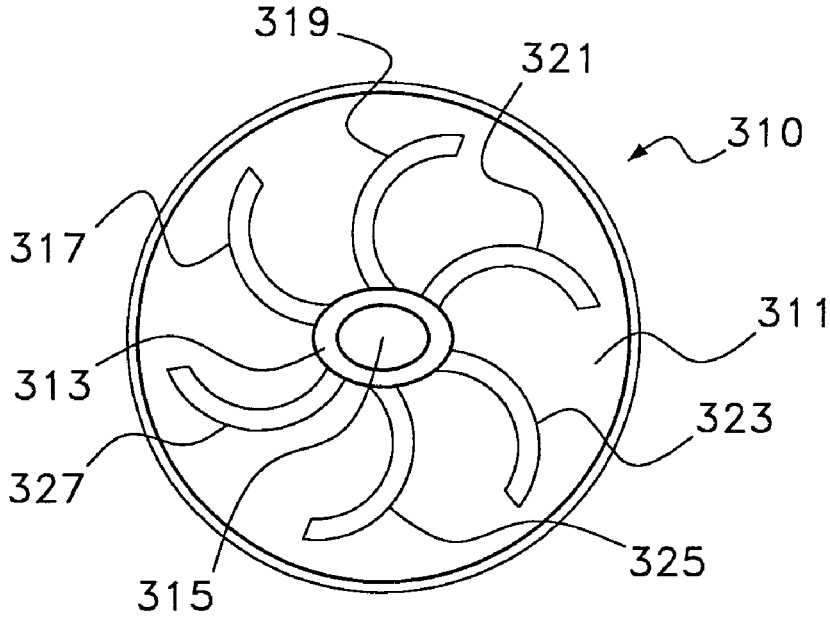
FIGS. 11 and 12 show bottom views of additional present invention container dispenser device embodiments.
Figure 12:
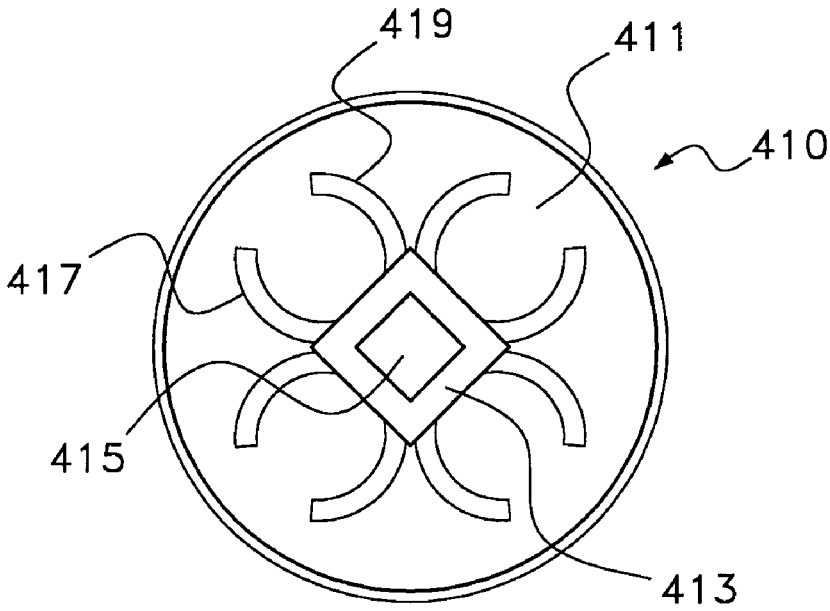

FIGS. 11 and 12 show bottom views of additional present invention container dispenser devices 310 and 410, respectively. Device 310 of FIG. 11 includes a base member 311, an elliptical dispensing tube 313 with orifice 315, and fins 317, 319, 321, 323, 325 and 327, as shown. Device 410 of FIG. 12 includes a base member 411, a square dispensing tube 413 with orifice 415, and fins such as fins 417 and 419, as shown.

Obviously, numerous modifications and variations of the present invention are possible in light of the above teachings. It is therefore understood that within the scope of the appended claims, the invention may be practiced otherwise than as specifically described herein.

What is claimed is:

1. A container dispenser device for handling separated flowable contents of a container, which consists of:

(a) a circular base member, said base member having a top and a bottom and a predetermined diameter, and having a top view footprint with a perimeter adapted to fit onto and seal a dispensing opening of a container, said base member having a dispensing orifice located thereon;

(b) a separator tube fixedly attached to said bottom of said base member at said dispensing orifice and extending downwardly therefrom; and (c) a plurality of mixing ribs external from said separator tube and fixedly attached to at least one of said separator tube and said base member, and extending downwardly away from said bottom of said base member.

2. The container dispenser device of claim 1 wherein each of said plurality of mixing ribs is connected to both of said base member and said dispenser tube.

3. The container dispenser device of claim 1 wherein said plurality of mixing ribs is a plurality of mixing spikes.

4. The container dispenser device of claim 3 wherein said plurality of spikes is connected to said base member.

5. The container dispenser device of claim 3 wherein said plurality of spikes is connected to said dispenser tube.

6. The container dispenser device of claim 1 wherein said plurality of mixing ribs is a plurality of mixing fins.

7. The container dispenser device of claim 6 wherein each of said plurality of mixing fins includes at least one opening therein.

8. The container dispenser device of claim 6 wherein said plurality of mixing fins is connected to said base member.

9. The container dispenser device of claim 6 wherein said plurality of mixing fins is connected to said dispenser tube.

10. A container dispenser cap device for handling separated flowable contents of a container, which consists of:

(a) a circular base member, said base member having a top and a bottom, and having a top view footprint with a perimeter adapted to fit onto and seal a dispensing opening of a container, said base member having means for attaching said cap device to a container, said base member having a dispensing orifice located thereon, said base member having a predetermined diameter;

(b) a separator tube fixedly attached to said bottom of said base member at said dispensing orifice and extending downwardly therefrom; and (c) a plurality of mixing ribs external from said separator tube and fixedly attached to at least one of said separator tube and said base member, and extending downwardly away from said bottom of said base member.

11. The container dispenser device of claim 10 wherein said plurality of mixing ribs is connected to both of said base member and said dispenser tube.

12. The container dispenser device of claim 10 wherein said plurality of mixing ribs is a plurality of mixing spikes.

13. The container dispenser device of claim 12 wherein said plurality of mixing spikes is connected to said base member.

14. The container dispenser device of claim 12 wherein said plurality of mixing spikes is connected to said dispenser tube.

15. The container dispenser device of claim 10 wherein said plurality of mixing ribs is a plurality of mixing fins.

16. The container dispenser device of claim 15 wherein each of said plurality of mixing fins includes at least one opening therein.

17. The container dispenser device of claim 15 wherein said plurality of mixing fins is connected to said base member.

18. The container dispenser device of claim 15 wherein said plurality of mixing fins is connected to said dispenser tube.

19. The container dispenser device of claim 10 wherein said plurality of mixing ribs is a plurality of vertical mixing fins having a triangular shape.

20. The container dispenser device of claim 11 wherein said plurality of mixing ribs is a plurality of vertical mixing fins having a triangular shape.

* * * * *